US009057375B2

(12) United States Patent
Ohlsen

(10) Patent No.: US 9,057,375 B2
(45) Date of Patent: Jun. 16, 2015

(54) COMPRESSOR WITH LOW FRICTION SEALING

(75) Inventor: Niels Lennart Ohlsen, Falsterbo (SE)

(73) Assignee: Manomeka AB, Skanor (SE)

( * ) Notice: Subject to any disclaimer, the term of this patent is extended or adjusted under 35 U.S.C. 154(b) by 106 days.

(21) Appl. No.: 13/885,100

(22) PCT Filed: Dec. 28, 2011

(86) PCT No.: PCT/SE2011/000249

§ 371 (c)(1),
(2), (4) Date: May 13, 2013

(87) PCT Pub. No.: WO2012/096597

PCT Pub. Date: Jul. 19, 2012

(65) Prior Publication Data

US 2013/0236343 A1 Sep. 12, 2013

(30) Foreign Application Priority Data

Jan. 10, 2011 (SE) ..... 1100018-9

(51) Int. Cl.

| | |
|---|---|
| ***F04C 21/00*** | (2006.01) |
| ***F04C 27/00*** | (2006.01) |
| ***F01C 21/00*** | (2006.01) |
| *F01C 21/08* | (2006.01) |

(52) U.S. Cl.

CPC ..... *F04C 21/00* (2013.01); *F01C 21/003* (2013.01); *F01C 21/08* (2013.01); *F04C 27/005* (2013.01)

(58) Field of Classification Search

CPC ..... F04C 21/00; F04C 27/005
USPC ..... 418/215, 217, 218, 219; 417/481
See application file for complete search history.

(56) References Cited

U.S. PATENT DOCUMENTS 263,573 A 8/1882 Patten
726,024 A * 4/1903 Butin ..... 418/218

(Continued)

FOREIGN PATENT DOCUMENTS

| | | |
|---|---|---|
| GB | 1423673 | 5/1920 |
| GB | 2009852 | 6/1979 |
| WO | 0233238 | 4/2002 |

OTHER PUBLICATIONS

International Search Report from International Application No. PCT/SE2011/000249, mailed on Apr. 3, 2012.

*Primary Examiner* — Mary A Davis
(74) *Attorney, Agent, or Firm* — Renner, Otto, Boisselle & Sklar, LLP

(57) ABSTRACT

The invention relates to a compressor comprising a rotatable portion where the active volume is divided by transverse wings (4*a-b*) and a rotatable ring element (2) with its normal at an angle to the rotation axis of the transverse wings. In any of their embodiments the sealing wings are attached to sealing holder taps (16*bd*1-2, 16*ac*1-2) that pass through driving slits (11*a*1-2, 11*b*1-2). The driving slits extend essentially parallel to the rotation axis of the transverse wings. Steering and driving the sealing wings in this fashion using the driving slits, aligns the sealing wings against the transverse wings, restricting wear of the sealing wings and decreasing friction. In one embodiment the sealing holder taps are provided with sliders (17, 17*a*1-2, 17*b*1-2, 17*c*1-2, 17*c*1-2), guiding and further reducing wear of the sealing wings and decreasing friction, by means of guides (22*a-d*). The invention further relates to such a compressor with the means (7, 18, 19) for arranging the ring element with its normal at a changeable angle to the main rotation axis thereby changing the compression ratio.

20 Claims, 13 Drawing Sheets

(56) References Cited

U.S. PATENT DOCUMENTS 2,584,426 A * 2/1952 Crane ..... 418/215
4,648,813 A * 3/1987 Mikulan ..... 418/49
5,735,172 A 4/1998 Parker
2008/0202466 A1 * 8/2008 Webster ..... 418/195

* cited by examiner

COMPRESSOR WITH LOW FRICTION SEALING

TECHNICAL FIELD

The invention relates to a compressor comprising a rotatable portion where the active volume is divided by transverse wings and a rotatable ring element with its normal at an angle to the rotation axis of the transverse wings. In any of their embodiments sealing wings are attached to sealing holder taps that pass through driving slits. The driving slits extend essentially parallel to the rotation axis of the transverse wings. Steering and driving the sealing wings in this fashion using the driving slits, aligns the sealing wings against the transverse wings, restricting wear of the sealing wings and decreasing friction.

BACKGROUND ART

A particular kind of rotary pump is known by for example GB 1423673. It has a ring shaped portion aligned at an angle to the rotational axis of the pump, and additional elements that force a fluid to rotate along the angled ring. Sealing between these elements is hard to achieve and a solution has previously been attempted by the application of moveable sealing elements that are pressed using springs against the elements that force the fluid to rotate. Applying force to a seal aligned against a moving surface causes excessive seal wear and also gives rise to friction.

An object of the invention is therefore to provide a compressor with both sufficient sealing and with reduced seal wear.

Another object of the invention is therefore to provide a compressor with reduced friction loss.

These and other objects are attained by a compressor according to the characterizing portion of the independent claim.

DISCLOSURE OF INVENTION

The invention relates to a compressor comprising a rotatable portion enclosed in an enclosure 13 with a fluid entrance 14 and exit 15. A main part of rotatable portion is rotatable around a rotation axis, and this rotatable portion may comprise a top 5*a* and a bottom 5*b* which in conjunction with the compressor enclosure 13 encloses a volume. This volume is divided by at least two transverse wings 4*a-b* that extend between the top and/or the bottom of either 5*a* and/or 5*b* (if present) or between the top and bottom of the compressor enclosure. This divided volume is in turn being subdivided by an ring element 2 extending between the transverse wing(s) and being provided by means 7, 18, 19 for arranging the ring element with its normal at an angle to the rotation axis. The ring element is provided with first slits for receiving at least one transverse wing.

In one embodiment of the invention the ring element is provided with slits for receiving sealing wings 3, 3*a*1-2, 3*b*1-2, 3*c*1-2, 3*d*1-2, in other embodiments, 23, 24 the sealing wings wrap at least partially around the ring element; in any embodiment the sealing wings extend essentially parallel to the plane of the ring element, and the sealing wings are attached to sealing holder taps 16*bd*1-2, 16*ac*1-2 that extend essentially towards the rotation axis and pass through driving slits 11*a*1-2, 11*b*1-2 in at least one ball element 8, 9, 20 arranged around the centre of the compressor. The driving slits extend essentially parallel to the rotation axis.

Steering the sealing wings in this fashion using the driving slits, position the sealing wings at a desired (essentially fixed) distance to the corresponding transverse wing and preferably aligns the sealing wings against the transverse wing, advantageously restricting wear of the sealing wings and reducing the friction caused by the sealing wings as compared to solutions known in the art.

In an advantageous embodiment, at least one ball element 8, 18, 19 is provided with an essentially spherical interior wall, and the sealing holder taps are provided with sliders 17, 17*a*1-2, 17*b*1-2, 17*c*1-2, 17*c*1-2 guided by a the ball 18, 19 being equipped by guides 22*a-d* thereby ensuring that the sealing holder taps and therefore the sealing wings are kept essentially in the plane of the ring element 2, essentially making the relative motion between the sealing wings and the ring elements 2*a-d* frictionless. Said sliders may, if equipped with an essentially spherical surface facing the spherical interior wall of the ball 18, 19, double as fluid and/or lubricant seals. In the latter case the sliders are essentially not applying pressure to the surface against which they seal, while still providing sufficient sealing and allowing for movement of the parts.

The invention further relates to such a compressor where the means 7, 18, 19 for arranging the ring element with its normal at an angle to the rotation axis is arranged such that the angle is changeable, thereby changing the compression ratio.

BEST MODES FOR CARRYING OUT THE INVENTION

FIGS. 1-6 shows the interior parts of the compressor according to the invention in three consecutive rotational steps, separated by a rotational step angle of 30°. The figures are intended to explain the functional basis of the compressor, and the external enclosure and other details have been eliminated from the figures in order to simplify.

The six figures are divided in two groups illustrating the interior parts of the compressor from the side and from an angle slightly above the plane constituting the symmetry plane of the interior parts. These two groups are constituted by FIGS. 1, 3 and 5, and 2, 4, and 6, respectively. In each pair of consecutive figures, the rotational angle is the same, as shown from two different viewing angles.

For circularly symmetric elements, the rotational angle is hard to tell visually, so rotational angle indicators 1 have been added to the figures. These obviously do not represent actual physical elements.

Figure 1:
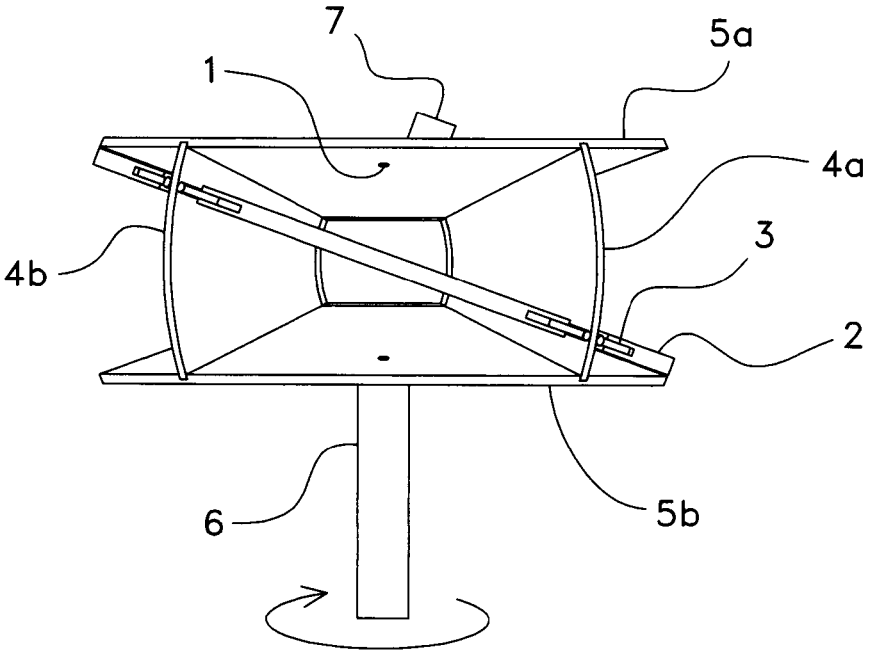
FIG. 1 shows, straight from the side, the interior parts of the compressor at a first rotational angle

FIG. 1 shows, straight from the side, the interior parts of the compressor at a first rotational angle. Every shown part in the figure rotates as the shaft 6 rotates, as indicated by the arrow at the bottom of the figure. 4*a-b*, 5*a-b* rotates about the shaft 6, while the shaft 7 rotates, at an angle which may be different from zero, relative to the shaft 6. The shaft 7 is throughout all FIGS. 1-6 set at a fixed angle with respect to shaft 6. The shaft 7 may be set at a different angle, giving a degree of compression different from the one achieved in FIGS. 1-6.

The shaft 6 extends upwards to the wing driver ball 8, which is only partly visible at the centre of the illustrated objects. The wing driver ball 8 is, in the embodiment shown in FIGS. 9 through 12, directly or indirectly mechanically connected to all other parts shown in the respective figures and drives the ring ball, not shown, via taps, or may, in the embodiment shown in FIGS. 1 through 6 and 16, 17, itself be directly or indirectly driven by the tap driver ball, in which case the wing driver ball is advantageously integrated with the delimiter wings shortly to be described and as the shaft 6 rotates the other elements rotate with it.

Figure 16:
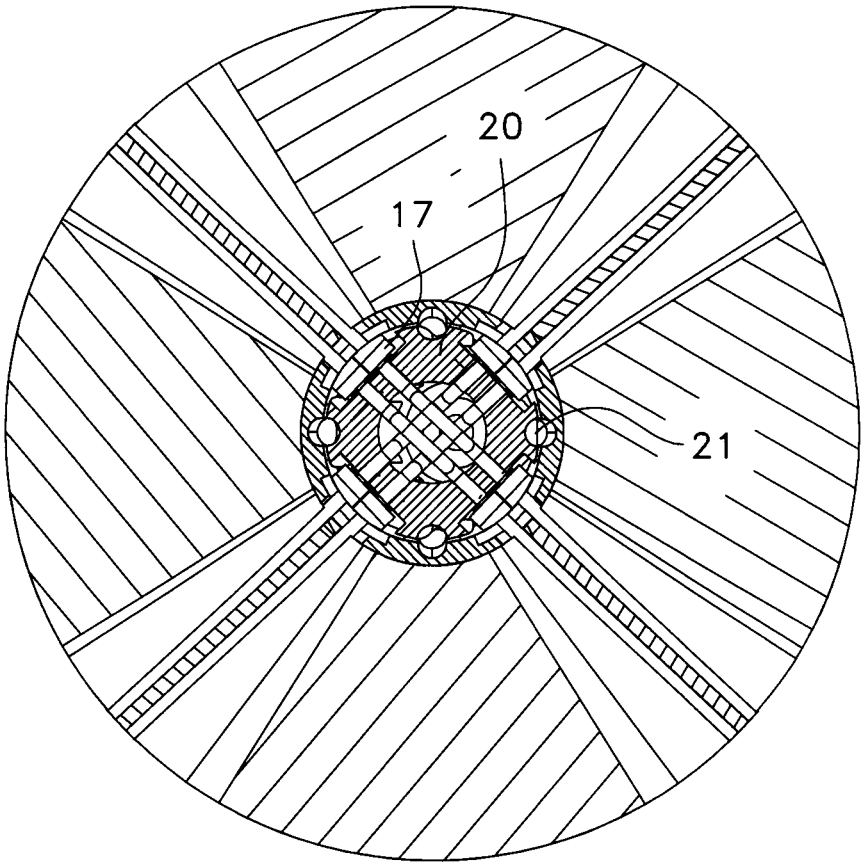
FIG. 16 shows the ring element with a second embodiment of the sealing wings, the ring driver ball and the tap driver ball
Figure 17:
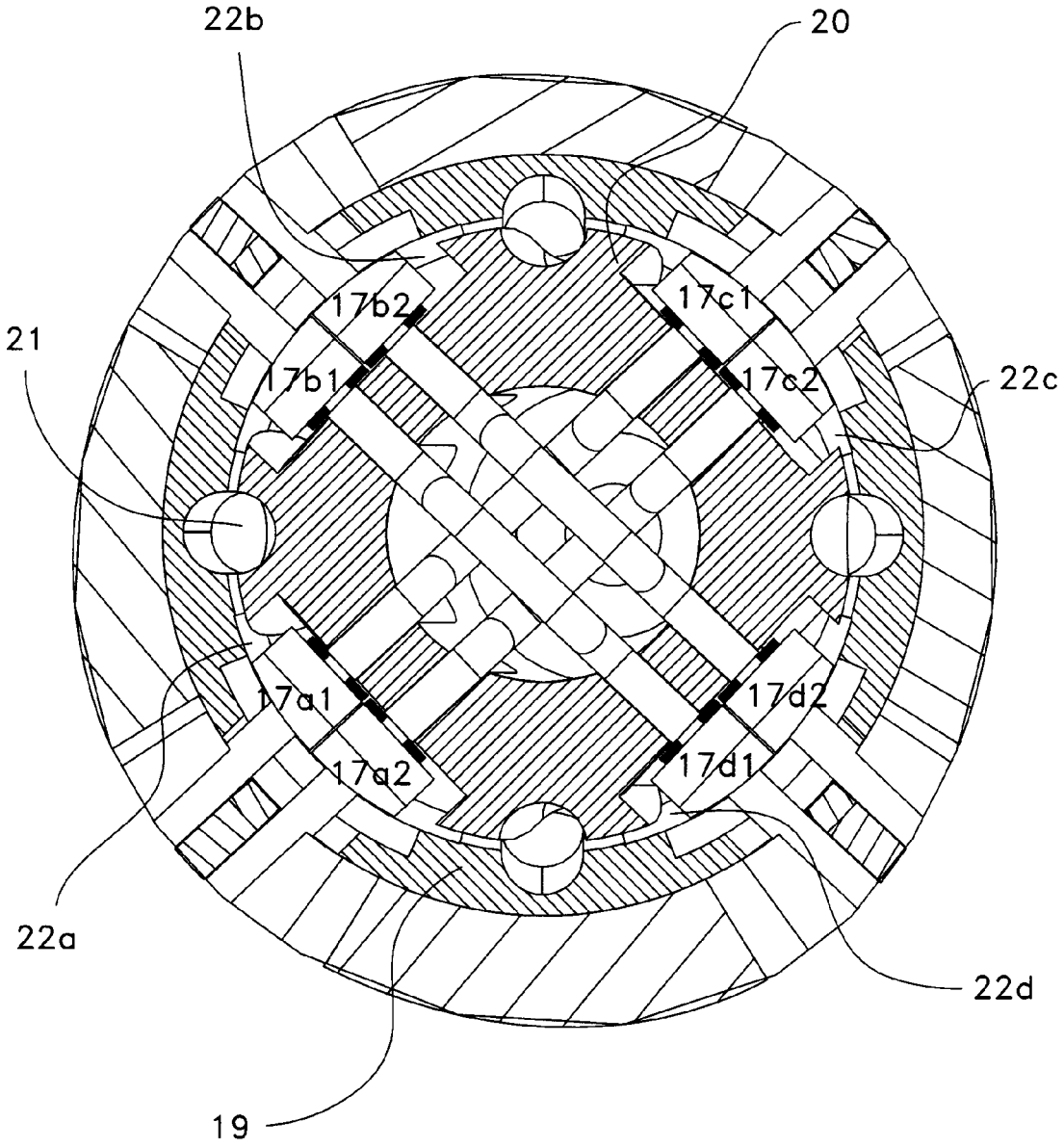
FIG. 17 shows a detailed view of the central portion of the compressor, including the sealing taps, the ring driver ball and the tap driver ball

In the nearby presented embodiment, the compressor comprises at least four delimiter wings 4*a-b*, 5*a-b*, where the top 5*a* and bottom 5*b* delimiter wings are constituted by thin, truncated cone shaped elements facing each other with respective cone tips facing. The truncated cone shaped top and bottom delimiter wings are arranged with their central axes coinciding with the central axis of the shaft 6. Said delimiter wings may, as before mentioned, in a second embodiment advantageously be integrated and directly connected to the shaft 6, in which case the wing driver ball may be essentially eliminated and a constant velocity joint (for instance a Rzeppa type joint or for instance a double universal joint) may be applied to transfer torque between the tap driver ball 20 and the ring driver ball 19, as indicated in FIGS. 16 and 17.

The top and bottom delimiter wings define a volume extending between them, which in turn is subdivided into, in this embodiment, four different volumes by four transverse delimiter wings 4*a-b*. The transverse delimiter wings are essentially plane, truncated circle sectors. The transverse delimiter wings are arranged between the top and bottom delimiter wings and each transverse delimiter wing extends from the top to the bottom delimiter wings, forming a right angle at each intersection between the transverse delimiter wing and the top and bottom delimiter wings. The transverse delimiter wings are evenly spaced apart around the top and bottom delimiter wings, and are, in the presented embodiment, spaced apart by essentially ninety degrees. The transverse delimiter wings are in the nearby embodiment air tightly attached to the top and the bottom delimiter wings, in conjunction with the compressor enclosure forming, in the present embodiment, four air tight compartments.

Each of the four compartments delimited by the six delimiter wings are further subdivided into totally eight compartments by a ring element 2, which in turn is constituted by a number of components, as described below. The ring element 2 is further essentially shaped as a circular disc, with four slits receiving each of the four transverse delimiter wings. In order to achieve air tightness, the ring element is provided with sealing wings 3 arranged in immediate vicinity of each transverse delimiter wing, and these will be discusses in greater detail below.

The ring element has its centre at the rotational axis of the delimiter wings, but is arranged with its axis offset from that axis. This means that as the interior parts of the compressor rotates, the volumes of each of the eight compartments increase or decrease (in the case where the offset differs from zero). This means that fluid entering one of the eight compartments at one rotational angle, selected by the non-illustrated enclosure described below, remains in that compartment as the compressor rotates. The volume of the compartment then decreases or increases as the compressor rotates, causing compression or decompression of the fluid, set by the ring element. The fluid then exits the compressor at an exit through the enclosure, giving the intended compression or decompression.

Figure 2:
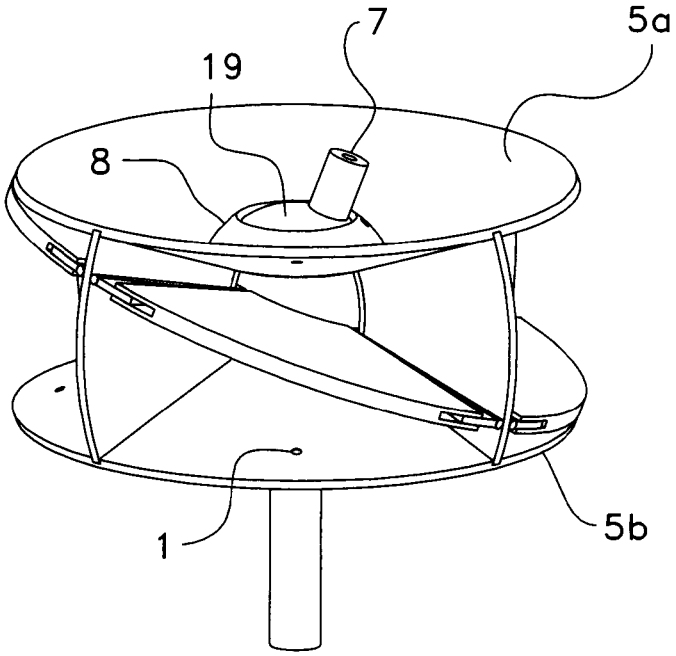
FIG. 2 shows, from an angle slightly above the side view, the interior parts of the compressor at the first rotational angle
Figure 3:
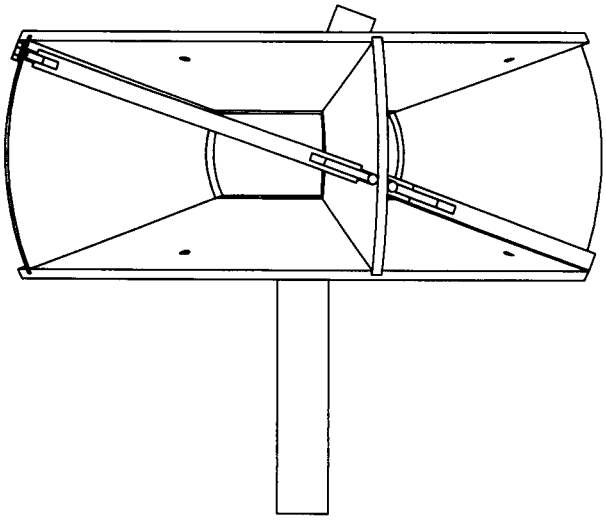
FIG. 3 shows, straight from the side, the interior parts of the compressor at a second rotational angle
Figure 4:
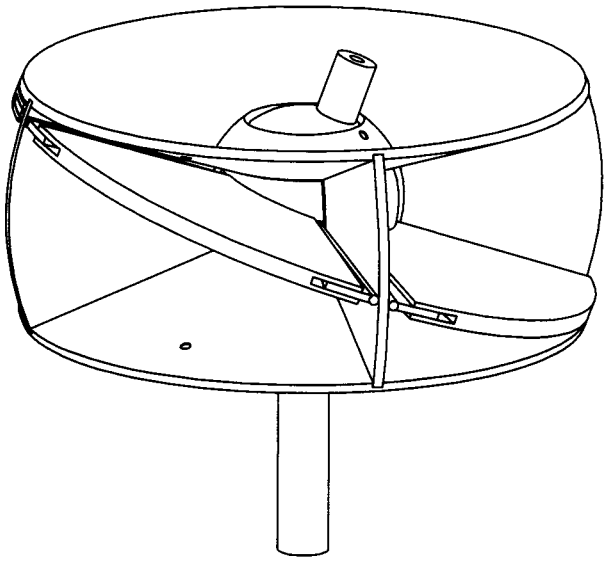
FIG. 4 shows, from an angle slightly above the side view, the interior parts of the compressor at the second rotational angle
Figure 5:
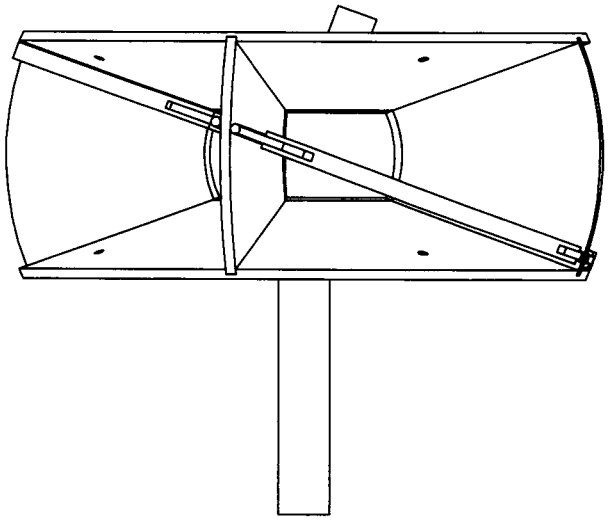
FIG. 5 shows, straight from the side, the interior parts of the compressor at a third rotational angle
Figure 6:
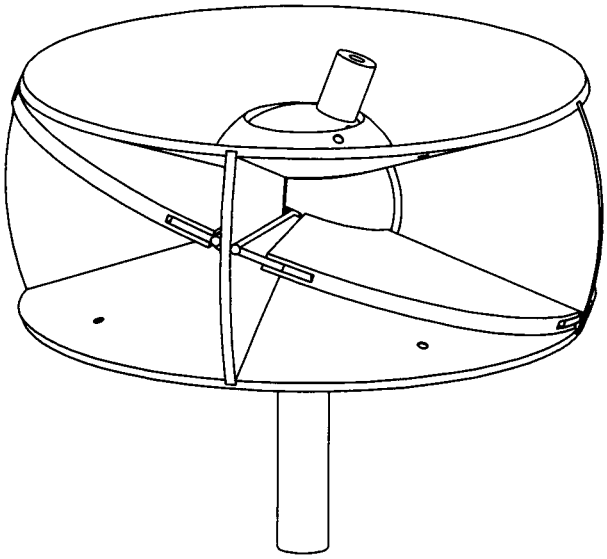
FIG. 6 shows, from an angle slightly above the side view, the interior parts of the compressor at the third rotational angle

FIG. 2 shows, from an angle slightly above the side view, the interior parts of the compressor at the first rotational angle. In this view, the shaft 7 is clearly visible.

The angle between shafts 6 and 7 determines the relative angle between the rotational axis of the ring element and the delimiter wings, thereby determining the compression ratio.

From this view, an embodiment of the ring driver ball 19, attached to shaft 7 and arranged inside the wing driver ball 8, in this embodiment integrated with and essentially replaced by the delimiter wings, is also visible.

At the selected angle between the shafts 6 and 7, the ring element reaches all the way from the bottom delimiter wing 5*b* to the top delimiter wing 5*a* causing the compression to reach its maximum.

FIG. 3-6 shows, straight from the side and from angle slightly above the side view, respectively, how the interior parts of the compressor moves to a second and then a third rotational angle. As this rotation takes place, each of the sealing wings 3 move up or down the transverse delimiter wings and in order to achieve air tightness corresponding elements in prior art are typically pressed against the transverse delimiter wings using springs or some resilient substance. These causes wear on the seals and friction in the compressor.

In the compressor according to the invention, however, the sealing wings 3, 23, 24 are arranged against the transverse delimiter wings without applying any force between the sealing wings and the transverse delimiter wings, using an inventive solution described in detail below.

Figure 7:
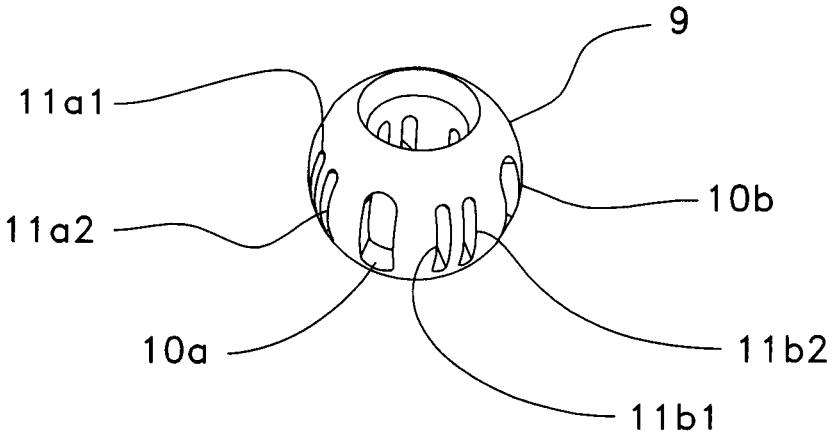
FIG. 7 shows a tap driver ball
Figure 8:
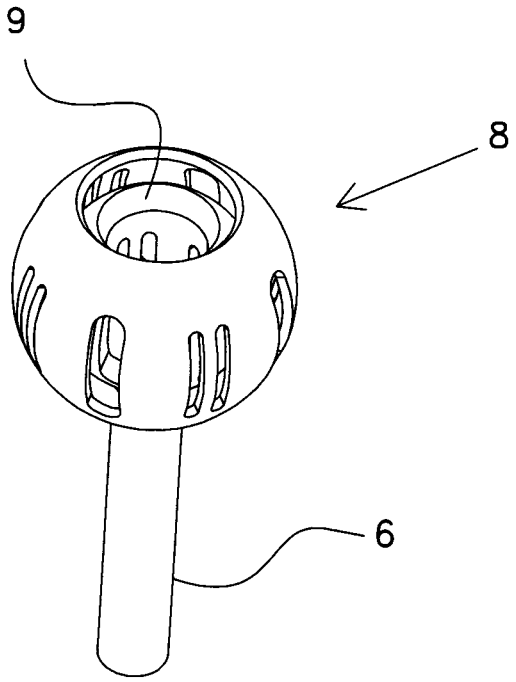
FIG. 8 shows a wing driver ball

FIG. 7 shows a tap driver ball and FIG. 8 shows a wing driver ball, which have some features in common. Both are hollow spheres with a through bore extending through the centre of each ball. The through holes define a central axis for each of the balls, and two sets of slits extend in parallel with the central axis on both balls.

In the presented embodiment, the first set of four wider tap slits 10*a-b* are spaced apart by ninety degrees between consecutive slits around the balls and are intended to receive four holder taps for the ring element with which the ring element in this embodiment is driven. The second set of four pairs of narrower driving slits 11*a*1-2, 11*b*1-2 are in the presented embodiment also spaced apart by ninety degrees between consecutive pairs, but the second set of slits are offset by essentially 45 degrees relative to the first set, evenly spacing each slit or pair of slits apart. The second set of pairs of slits is in the present embodiment arranged to receive eight holder taps for the sealing wings.

The tap driver ball is intended to drive and govern the motion of the sealing holder taps 16 and is, as is the case for the wing driver ball, connected to the shaft 6.

In this embodiment the selector ball 18, to which the shaft 7 is fixed, will be situated in between the wing driver ball 8 and the tap driver ball 9, and will be driven by the wing driver ball via taps.

FIG. 8 shows the wing driver ball 8 with the tap driver ball 9, and the shaft 6 connected to both.

As illustrated, the wing driver ball and the tap driver ball are arranged such that corresponding slits in the respective balls overlap. This makes it possible to insert the sealing wing holder taps into the slits and these may extend into the tap driver ball. As corresponding slits overlap, this allows for the holder taps to move up or down in the slits, which makes it possible to angle the ring driver shaft 7 with respect to the shaft 6, thus allowing for varying degrees of compression.

Figure 9:
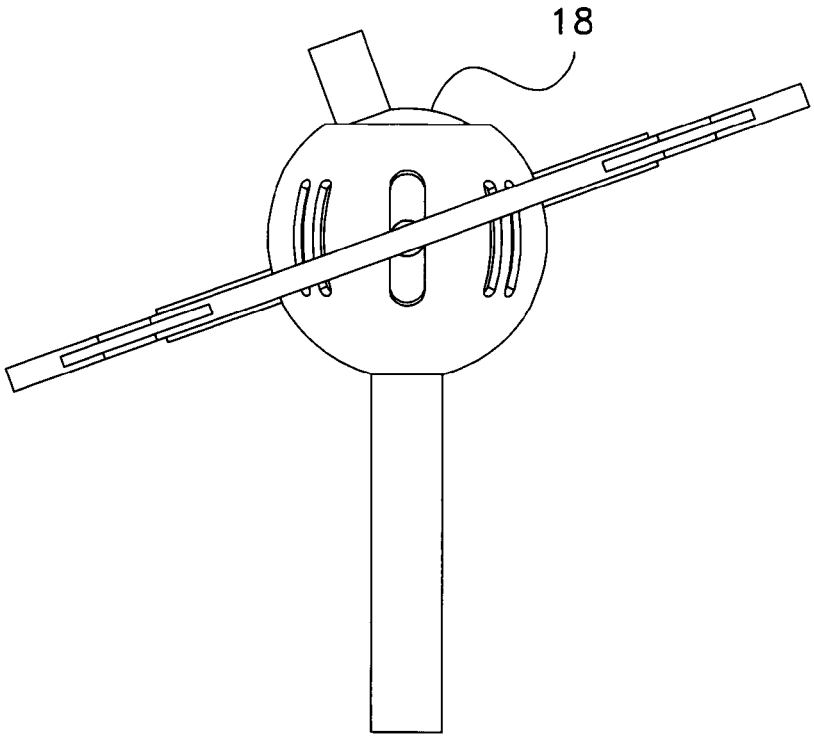
FIG. 9 shows the interior parts with a ring element as seen straight from the side and also shows an embodiment of the ring driver ball
Figure 10:
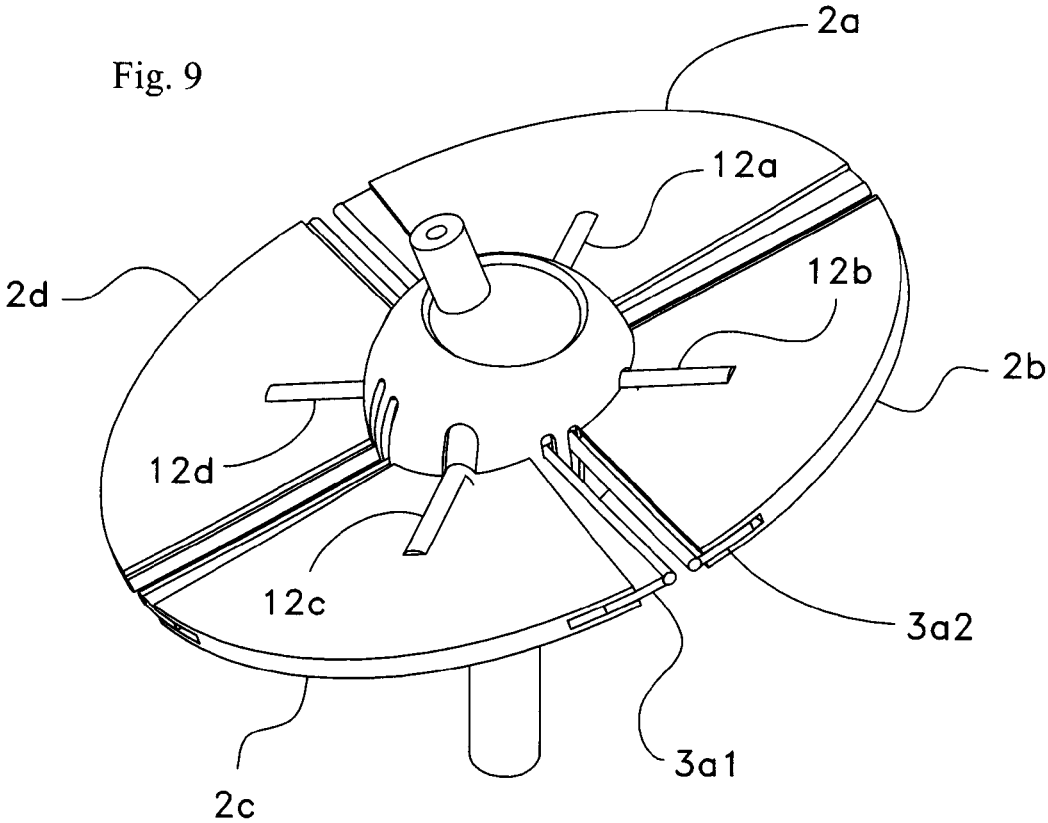
FIG. 10 shows the interior parts with the ring element as seen from an angle slightly above the side view

The driving slits 11*a*1-2, 11*b*1-2 allow the sealing wings to move up and down with the ring elements, while controlling the relative rotational angle between the sealing wings and the transverse delimiter wings and providing the necessary force to drive the sealing holder taps, overcoming any (lubricated) friction between said sealing holder taps and the tap driver ball. The sealing holder taps are intended to keep the sealing wings in the immediate vicinity of, or against the transverse delimiter wings, without applying any force between them. This is achieved independent of how the ring driver ball is angled with respect to the wing driver ball, and throughout a full turn of the compressor. Furthermore, the sealing taps effectively cancel the centripetal force acting on each pair of sealing wings, thereby avoiding any friction between the sealing wings and the outer enclosure FIG. 9 shows the interior parts with the ring element as seen straight from the side, and FIG. 10 shows the interior parts with the ring element as seen from an angle slightly above the side view. In FIG. 10 in particular, it is clearly illustrated how in this embodiment the ring elements are provided with holder taps 12*a-b* extending from the rings into the ring element slits.

As shown in FIG. 1 through 6 and FIGS. 16 and 17, the ring elements may, in another embodiment, simply be integrated and directly connected to the shaft 6, in which embodiment the wing driver ball may be essentially eliminated and a constant velocity joint (for instance a Rzeppa type joint or a double universal joint) may be applied to transfer torque between the tap driver ball and the ring driver ball 19, as indicated in FIGS. 16 and 17, in which case the ring element slits 10*a-b* become redundant.

The figure also illustrates how the sealing wings 3*a*1-2 in one embodiment of the invention are arranged in slits in the ring elements, extending in parallel with the top surface of the ring elements. These slits in the rings elements cause the sealing wings to follow the up and downward movement along the transverse delimiter wings. It is clearly illustrated in FIG. 10 how slits in the wing driver ball allow for the up- and downward movement of the sealing wings such that they always are aligned against the sides of the transverse delimiter wings, achieving a tight seal.

Figure 11:
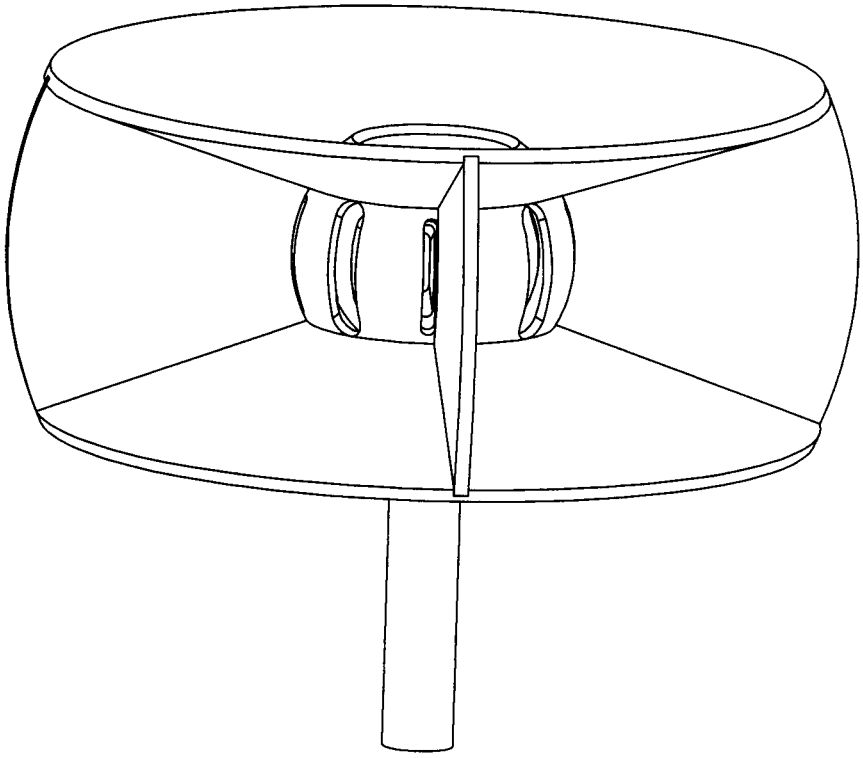
FIG. 11 shows an embodiment of the interior parts with delimiter wings and without the ring element

FIG. 11 shows the interior parts with delimiter wings and with the ring element removed for clarity. The delimited wings are, in this embodiment, air tightly attached to the wing driver ball, with each transverse delimiter wing arranged along the string of the driver ball that extends between each slit in the sealing slit pairs.

Figure 12:
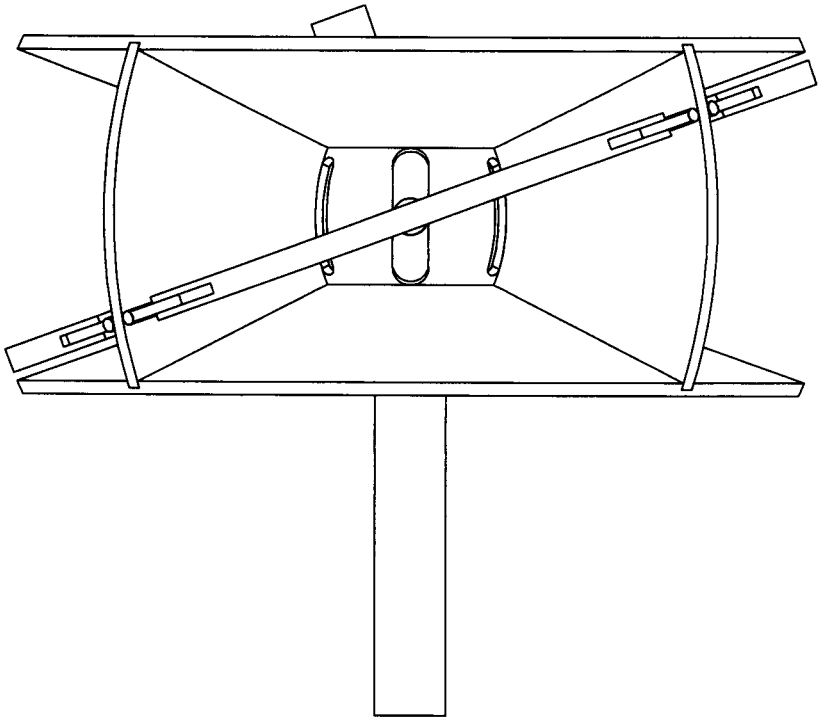
FIG. 12 shows the interior parts with delimiter wings and the ring element

FIG. 12 shows the interior parts with delimiter wings and the ring element. Again, it is illustrated how the ring elements and the delimiter wings, in conjunction with the wing driver ball and the not illustrated outer enclosure, define eight compartments that increase or decrease in volume as the compressor rotates.

The figure also shows how the slits in the ring elements, receiving the sealing wings, are sufficiently deep to receive essentially the full width of the sealing wings, but the driving slits position the sealing wings such that they extend out of the slits, achieving an air tight seal.

Figure 13:
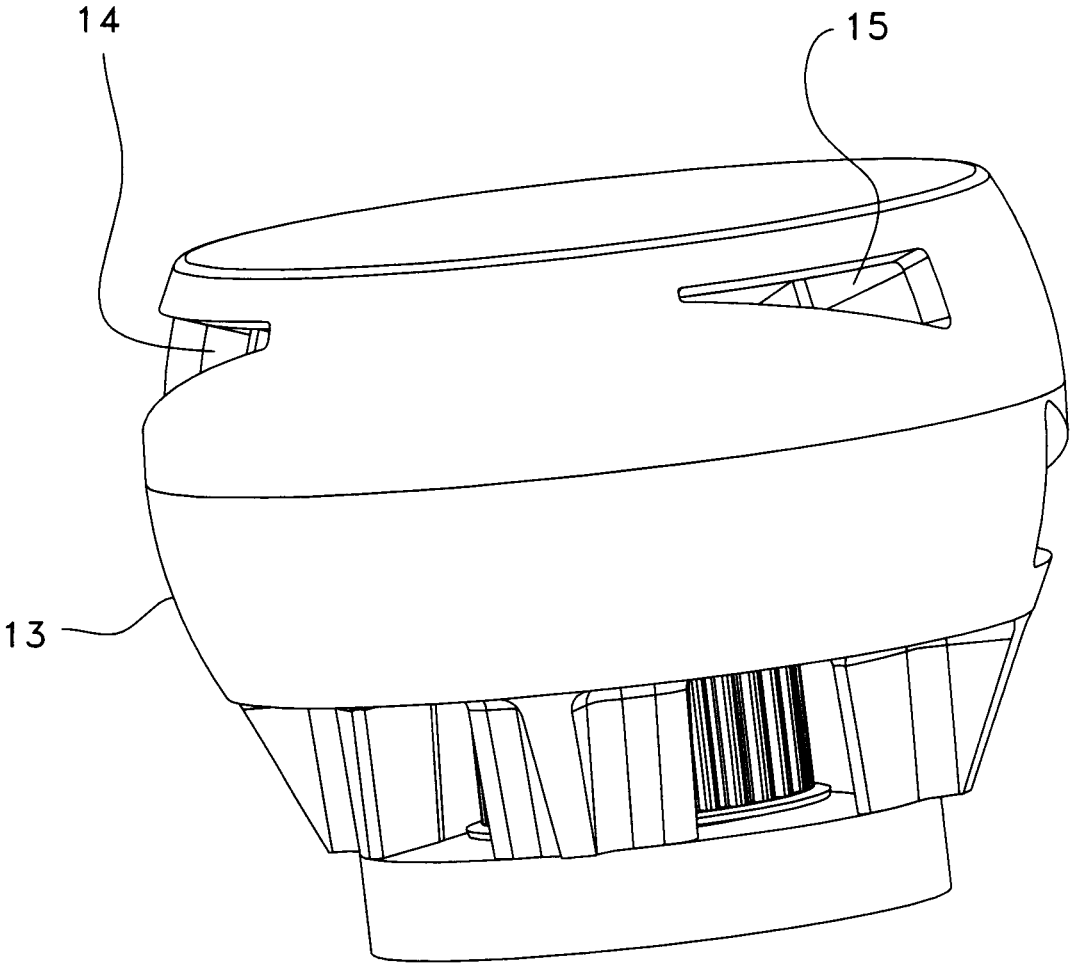
FIG. 13 shows the compressor enclosure

FIG. 13 shows the compressor enclosure 13, enclosing the internal parts of the compressor and achieving the (in the presented embodiment) eight final, completely enclosed, compartments that perform the actual pumping or compression action. The enclosure is provided with entrance openings 14 and exit openings 15, through which fluids enter into and exit from the compressor.

Figure 14:
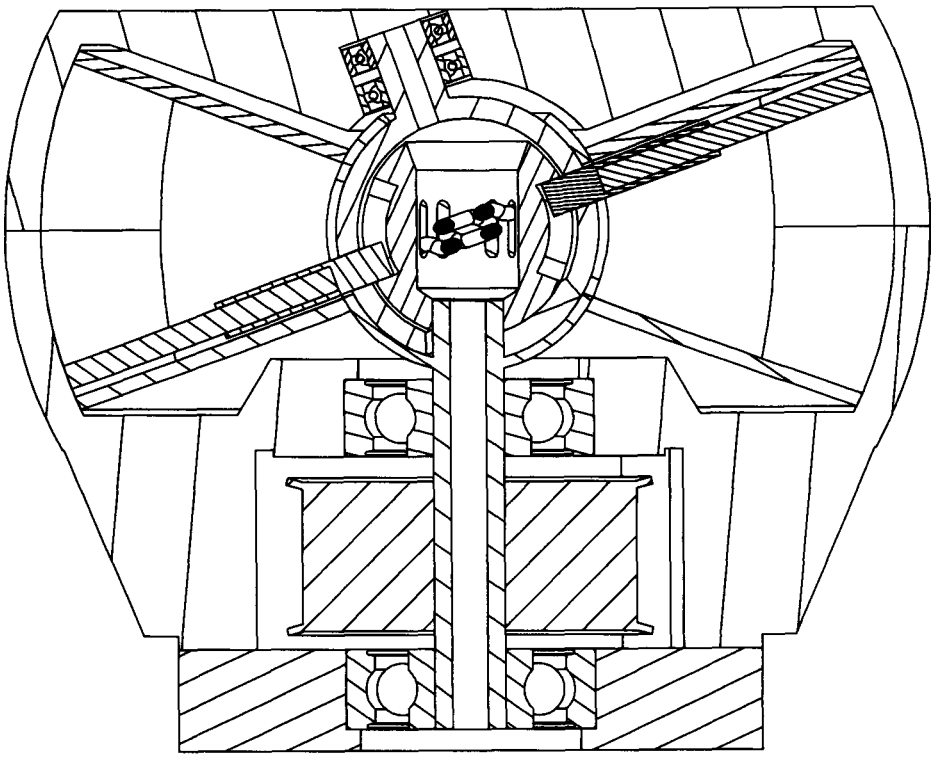
FIG. 14 shows the compressor enclosure and interior parts in cross section

FIG. 14 shows the compressor enclosure and interior parts in cross section, and here parts of the intricacies surrounding the sealing wing holder taps are illustrated, as will be more thoroughly detailed below.

Figure 15:
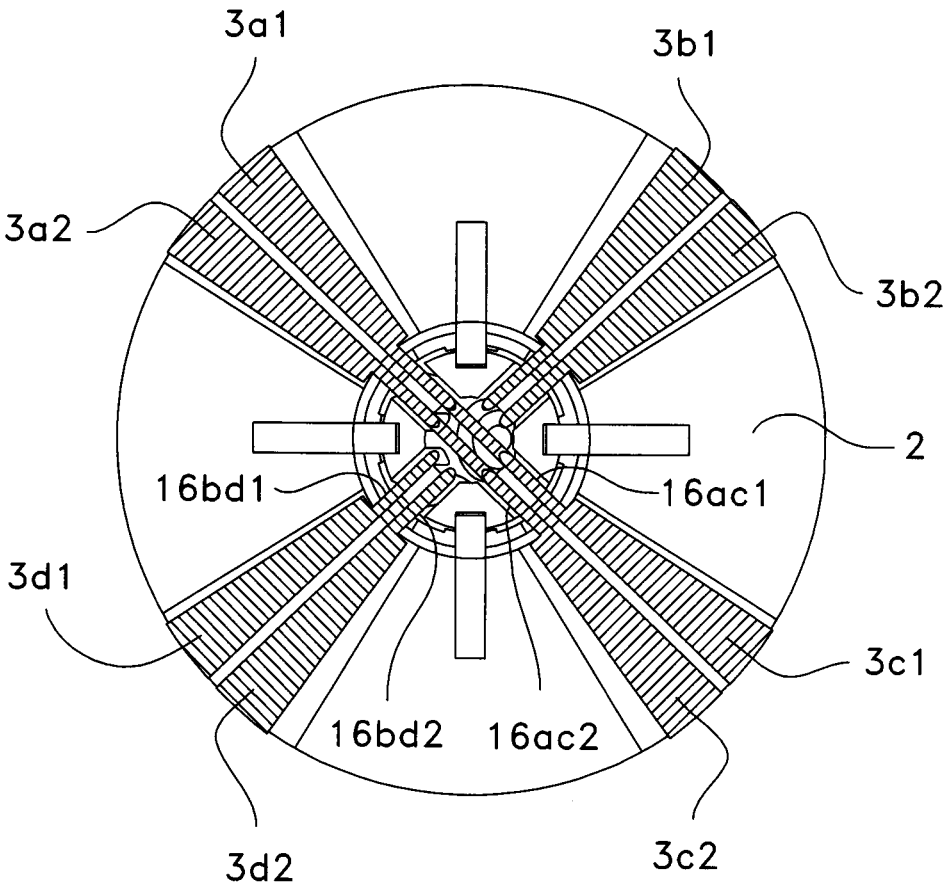
FIG. 15 shows the ring element with a first embodiment of the sealing wings

FIG. 15 shows the ring elements with an embodiment of the sealing wings 3*a*1-2, 3*b*1-2 with attached sealing holder taps 16*bd*1-2, 16*ac*1-2. Each sealing wing is attached to a corresponding sealing wing on the opposite side of the compressor, such that sealing wing 3*a*1 is attached to sealing wing 3*c*1 with sealing holder tap 16*ac*1, and correspondingly for each pair of oppositely positioned sealing wings.

For each pair of sealing wings, such as the pair 3*a*1-2, the respective sealing holder tap 16*ac*1-2 runs in parallel to the sealing holder tap of the pair of sealing wings 3*c*1-2 on the opposite side of the centre. This would have meant that one parallel pair of sealing holder taps would cross another pair of sealing holder taps at the centre, but the sealing holder taps are bent near the centre such as to be offset upwards and downwards, respectively, in the figure. This bend near the centre eliminates the crossing problem that would otherwise have occurred.

FIG. 16 shows a second embodiment of ring elements, the sealing wings, the ring driver ball 19 and the tap driver ball 20.

In the previous embodiment, the sealing wings were dashed for easy identification, while in FIGS. 16-17 objects other than the sealing wings are dashed. The second embodiment differs from the first embodiment in that eight sliders 17*a*1-2, 17*b*1-2, 17*c*1-2, 17*d*1-2 guide the sealing holder taps via guides 22*a-d* in the ring driver ball 19 and in that the ring driver ball is integrated with the ring elements 21 and that the delimiter wings are integrated and directly connected to the shaft 6, essentially eliminating the wing driver ball. A constant velocity joint (for instance a Rzeppa type or a double universal type joint) may be applied to transfer torque between the tap driver ball 20 and the ring driver ball, the balls of a Rzeppa type joint placed in tracks 21.

FIG. 17 shows a detailed view of an embodiment of the central portion of the compressor. Near the intersection between the sealing wings and the sealing holder taps, sliders 17*a*1-2, 17*b*1-2, 17*c*1-2, 17*d*1-2 are illustrated in greater detail. Said sliders may be restricted by guides 22*a-d* in the ring driver ball 19, thereby ensuring that the sealing holder taps and thus the sealing wings are kept essentially in the plane of the ring element 2, essentially making the relative local motion between the sealing wings and the ring element wings 2*a-d* frictionless. Said sliders may, if equipped with essentially spherical surfaces facing the spherical interior wall of the wing driver ball, double as lubricant and/or fluid seals in which case the sliders, as they rotate around the centre of the compressor, move along the interior wall of the ring driver ball and align there against no matter in which position the sealing wings are with respect to the transverse delimiter wings.

Again, this means that essentially no force is applied to the sliders against the interior wall of the ring driver ball, reducing wear and friction. If a sufficient alignment is achieved, lubricant and/or fluid tightness may be achieved. In applications with sufficiently minor loads on the sealing holder taps, it will be possible to operate the described parts of the compressor entirely without liquid lubrication, and any necessary lubrication may be obtained via solid lubricant materials, such as for instance PTFE.

Figure 18:
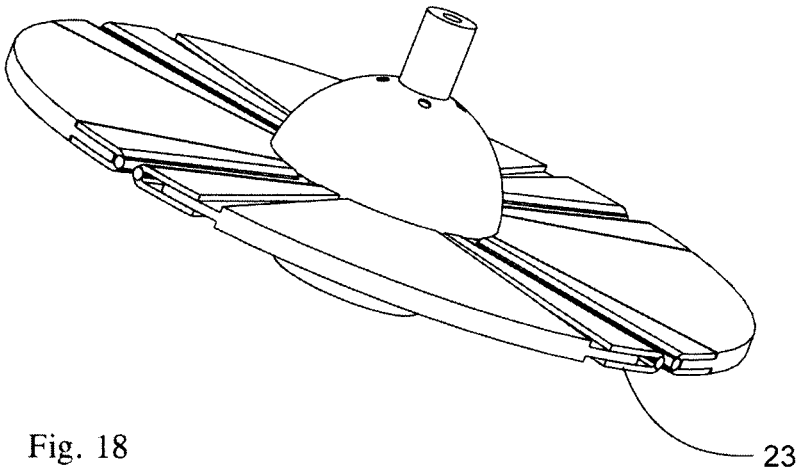
FIG. 18 shows an alternative embodiment of the sealing wings

FIG. 18 shows an alternative embodiment of the sealing wings where the sealing wings wrap around the ring element instead of penetrating the ring elements through slits.

Figure 19:
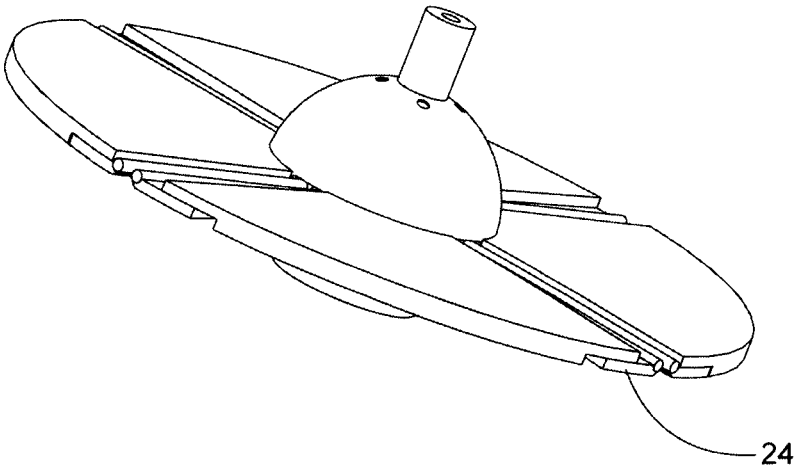
FIG. 19 shows yet another alternative embodiment of the sealing wings

FIG. 19 shows yet another alternative embodiment of the sealing wings where the sealing wings wrap around the ring element to a lesser degree than in FIG. 18, again instead of penetrating the ring elements through slits.

In the present description the word 'compressor' is used, as just a generalized denotation and by 'compressor' is meant a compressor, a pump used for increasing pressure, a pump used for decreasing pressure or any other similar machine.

INDUSTRIAL APPLICABILITY

The claimed invention may serve as a pump of liquid media or a compressor of gaseous media, for instance in, but not limited to, the following applications: Fuel pressurization (fuel pump), oil pressurization (oil pump, continuously variable transmission), air compression (industrial air compression, supercharging of internal combustion engines, fuel cell air supply).

What is claimed is:

1. A compressor comprising a rotatable assembly enclosed in an enclosure with fluid entrances and exits, where a portion of the assembly is rotatable around a first rotation axis, and where said portion comprises at least two transverse wings, the enclosed volume being further subdivided by a rotatable ring element which is rotatable about a second rotation axis and which extends between adjacent transverse wings and which is provided with means for arranging the rotatable ring element with its normal at an angle to the first rotation axis, and where the rotatable ring element is further provided with slits for receiving the at least two transverse wings, wherein the rotatable ring element is provided with second slits for receiving sealing wings and the sealing wings extend essentially parallel to the rotatable ring element and the sealing wings are attached to sealing holder taps that extend essentially towards the center of the compressor and pass through driving slits in at least one ball element arranged around the center of the compressor, where the driving slits extend essentially parallel to the first rotation axis and essentially parallel to the at least two transverse wings.

2. A compressor according to claim 1, wherein the sealing wings are arranged in pairs, with each sealing wing in such a pair situated on essentially opposite sides of the second rotation axis, and where the sealing wings in such a pair are connected by the respective one of the sealing holder taps.

3. A compressor according to claim 2, wherein the sealing holder taps are provided with a central portion being offset essentially in the direction of the second rotation axis.

4. A compressor according to claim 3, wherein the sealing holder taps are provided with guided sliders, and where guides restrict the guided sliders and thus the sealing wings to confined movement in essentially the plane of the rotatable ring element to ensure a virtually frictionless local movement of the sealing wings relative to the rotatable ring element.

5. A compressor according to claim 3, wherein the means for arranging the rotatable ring element with its normal at an angle to the first rotation axis is arranged such that the angle is changeable.

6. A compressor according to claim 2, wherein the sealing holder taps are provided with guided sliders, and where guides restrict the guided sliders and thus the sealing wings to confined movement in essentially the plane of the rotatable ring element to ensure a virtually frictionless local movement of the sealing wings relative to the rotatable ring element.

7. A compressor according to claim 2, wherein the means for arranging the rotatable ring element with its normal at an angle to the first rotation axis is arranged such that the angle is changeable.

8. A compressor according to claim 1, wherein the sealing holder taps are provided with guided sliders, and where guides restrict the guided sliders and thus the sealing wings to confined movement in essentially the plane of the rotatable ring element to ensure a virtually frictionless local movement of the sealing wings relative to the rotatable ring element.

9. A compressor according to claim 8, wherein the means for arranging the rotatable ring element with its normal at an angle to the first rotation axis is arranged such that the angle is changeable.

10. A compressor according to claim 1, wherein the means for arranging the rotatable ring element with its normal at an angle to the first rotation axis is arranged such that the angle is changeable.

11. A compressor comprising a rotatable assembly enclosed in an enclosure with fluid entrances and exits, where a portion of the assembly is rotatable around a first rotation axis, and where said portion comprises at least two transverse wings, the enclosed volume being further subdivided by a rotatable ring element which is rotatable about a second rotation axis and which extends between adjacent transverse wings and which is provided with means for arranging the rotatable ring element with its normal at an angle to the first rotation axis, and where the rotatable ring element is further provided with slits for receiving the at least two transverse wings wherein the sealing wings wrap at least partially around the rotatable ring element and the sealing wings extend essentially parallel to the rotatable ring element and the sealing wings are attached to sealing holder taps that extend essentially towards the center of the compressor and pass through driving slits in at least one ball element arranged around the center of the compressor, where the driving slits extend essentially parallel to the first rotation axis and essentially parallel to the at least two transverse wings.

12. A compressor according to claim 11, wherein the sealing wings are arranged in pairs, with each sealing wing in such a pair situated on essentially opposite sides of the second rotation axis, and where the sealing wings in such a pair are connected by the respective one of the sealing holder taps.

13. A compressor according to claim 12, wherein the sealing holder taps are provided with a central portion being offset essentially in the direction of the second rotation axis.

14. A compressor according to claim 13, wherein the sealing holder taps are provided with guided sliders, and where guides restrict the guided sliders and thus the sealing wings to confined movement in essentially the plane of the rotatable ring element to ensure a virtually frictionless local movement of the sealing wings relative to the rotatable ring element.

15. A compressor according to claim 13, wherein the means for arranging the rotatable ring element with its normal at an angle to the first rotation axis is arranged such that the angle is changeable.

16. A compressor according to claim 12, wherein the sealing holder taps are provided with guided sliders, and where guides restrict the guided sliders and thus the sealing wings to confined movement in essentially the plane of the rotatable ring element to ensure a virtually frictionless local movement of the sealing wings relative to the rotatable ring element.

17. A compressor according to claim 12, wherein the means for arranging the rotatable ring element with its normal at an angle to the first rotation axis is arranged such that the angle is changeable.

18. A compressor according to claim 11, wherein the sealing holder taps are provided with guided sliders, and where guides restrict the guided sliders and thus the sealing wings to confined movement in essentially the plane of the rotatable ring element to ensure a virtually frictionless local movement of the sealing wings relative to the rotatable ring element.

19. A compressor according to claim 18, wherein the means for arranging the rotatable ring element with its normal at an angle to the first rotation axis is arranged such that the angle is changeable.

20. A compressor according to claim 11, wherein the means for arranging the rotatable ring element with its normal at an angle to the first rotation axis is arranged such that the angle is changeable.

* * * * *